US008221609B2

(12) United States Patent
Fujita et al.

(10) Patent No.: US 8,221,609 B2
(45) Date of Patent: Jul. 17, 2012

(54) PROCESS FOR PRODUCING RARE METAL AND PRODUCTION SYSTEM THEREOF

(75) Inventors: Reiko Fujita, Nerima-ku (JP); Hitoshi Nakamura, Yokohama (JP); Koji Mizuguchi, Kawasaki (JP); Shohei Kanamura, Yokohama (JP); Takashi Omori, Adachi-ku (JP); Kazuhiro Utsunomiya, Yokohama (JP); Shunji Nomura, Suginami-ku (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 176 days.

(21) Appl. No.: 12/813,002

(22) Filed: Jun. 10, 2010

(65) Prior Publication Data

US 2010/0314260 A1 Dec. 16, 2010

(30) Foreign Application Priority Data

Jun. 15, 2009 (JP) ..... 2009-142565

(51) Int. Cl.

| | |
|---|---|
| ***C25C 3/34*** | (2006.01) |
| ***C25C 7/00*** | (2006.01) |
| ***C25B 1/00*** | (2006.01) |
| ***C25B 9/06*** | (2006.01) |
| *C25C 3/30* | (2006.01) |
| *C25B 1/21* | (2006.01) |

(52) U.S. Cl. ..... 205/367; 205/370; 205/539; 205/538; 204/267; 204/243.1; 204/252

(58) Field of Classification Search ..... None
See application file for complete search history.

(56) References Cited

U.S. PATENT DOCUMENTS 4,039,403 A * 8/1977 Astley et al. ..... 205/573
4,764,352 A * 8/1988 Bathellier et al. ..... 423/10
5,183,541 A * 2/1993 Snyder et al. ..... 205/560
5,894,077 A * 4/1999 Jones et al. ..... 588/20

FOREIGN PATENT DOCUMENTS

JP 2005-201765 7/2005

OTHER PUBLICATIONS

Cobble et al, Thermodynamic Properties of Technetium and Rhenium Compounds. II. Heats of Formation fo Technetium Heptoxide and Pertechnic Acid, Potential of the Technetium-(IV)-Technetium (VII) Couple, and a Potential Diagram for Technetium, Dec. 1953, Journal of American Chemical Society, vol. 75, pp. 5777-5782.*

Cobble et al, Chemistry of Technetium. II. Preparation of Technetium Metal, Apr. 1952, Journal of American Chemical Society, vol. 74, pp. 1852.*

Boyd et al, Thermodynamic Properties of Technetium and Rhenium Compounds. III. Heats of Formation of Rhenium Heptoxide and Trioxide, and a Revised Potential Diagram for Rhenium, Dec. 1953, Journal of American Chemical Society, vol. 75, pp. 5783-5784.*

* cited by examiner

*Primary Examiner* — Harry D Wilkins, III
(74) *Attorney, Agent, or Firm* — Oblon, Spivak, McClelland, Maier & Neustadt, L.L.P.

(57) ABSTRACT

According to one embodiment, a process for producing rare metals includes the steps of: electrolyzing an electrolytic solution to extract a Re oxide at a cathode; recovering the Re oxide, and electrolyzing the Re oxide in a molten salt electrolyte to extract metallic Re; recovering a Nd containing residue solution; treating the Nd containing residue solution to produce Nd oxide; electrolyzing the Nd oxide in a molten salt electrolyte to extract metallic Nd; recovering a Dy containing residue solution; treating the Dy containing residue solution to produce Dy oxide; and electrolyzing the Dy oxide in a molten salt electrolyte to extract metallic Dy.

7 Claims, 5 Drawing Sheets

$$ReO_4^- + 4H^+ + 3e^- \rightarrow ReO_2 + 2H_2O$$

$$4OH^- \rightarrow 2H_2O + O_2 + 4e^-$$

PROCESS FOR PRODUCING RARE METAL AND PRODUCTION SYSTEM THEREOF

CROSS-REFERENCE TO RELATED APPLICATIONS

This application is based upon and claims the benefit of priority from Japanese Patient application No. 2009-142565, filed on Jun. 15, 2009, the entire contents of each of which are incorporated herein by reference.

FIELD

Embodiments described herein relate generally to a technique for producing rare metals, and particularly relates to a technique for producing rhenium (Re), neodymium (Nd), and dysprosium (Dy) in a solution.

BACKGROUND

Rhenium (Re) is a particularly rare metal among rare metals, and is used to reinforce turbine materials for aircrafts, for example.

As a conventional process for producing metallic Re, a process is known in which ammonium perrhenate rhenium ($NH_4ReO_4$; (APR)) as an intermediate product is obtained from an ore, and reduced in a hydrogen stream at approximately 150° C. to obtain metallic Re.

Moreover, generally, rare earth metals, e.g., neodymium (Nd) and dysprosium (Dy) used as a raw material for magnets are difficult to separate individually because these elements have similar chemical properties.

As a conventional process for isolating these metallic Nd and Dy, a process is known in which an ore is dissolved with sulfuric acid and the like; subsequently, impurities such as alkali metals and platinum group metals are separated and removed by an oxalic acid precipitation method; and rare earth metals are separated from each other and reduced with calcium fluoride.

As an alternative process for isolating these rare earth metals, a process is known in which rare earth metals are separated from each other and recovered by volatilizing oxides of the rare earth metals in a molten salt (for example, Patent Document 1 (Japanese Patent Application Laid-Open No. 2005-201765)).

Unfortunately, in the conventional processes, consumption of acids, alkalis, organic solvents, and ion exchange resins produces a large amount of secondary wastes in the course that APR as an intermediate product in production of metallic Re is produced.

As another problem, the oxides of the rare earth metals such as Nd and Dy have a slow reduction rate, and it is difficult to reproduce a reducing agent used, again leading to production of a large amount of secondary wastes.

On the other hand, there has been no report on a technique to independently separate metallic Re and rare earth metals such as metallic Nd and metallic Dy and recover those metals through a series of steps.

DETAILED DESCRIPTION

In one embodiment, a process for producing rare metals comprises the steps of: electrolyzing an electrolytic solution containing at least a Re element to extract a Re oxide at a cathode; recovering the Re oxide; and electrolyzing the Re oxide in a first molten salt electrolyte to extract metallic Re at a cathode.

(A First Embodiment)

Hereinafter, embodiments according to the present invention will be described on the basis of the accompanying drawings.

Figure 1:
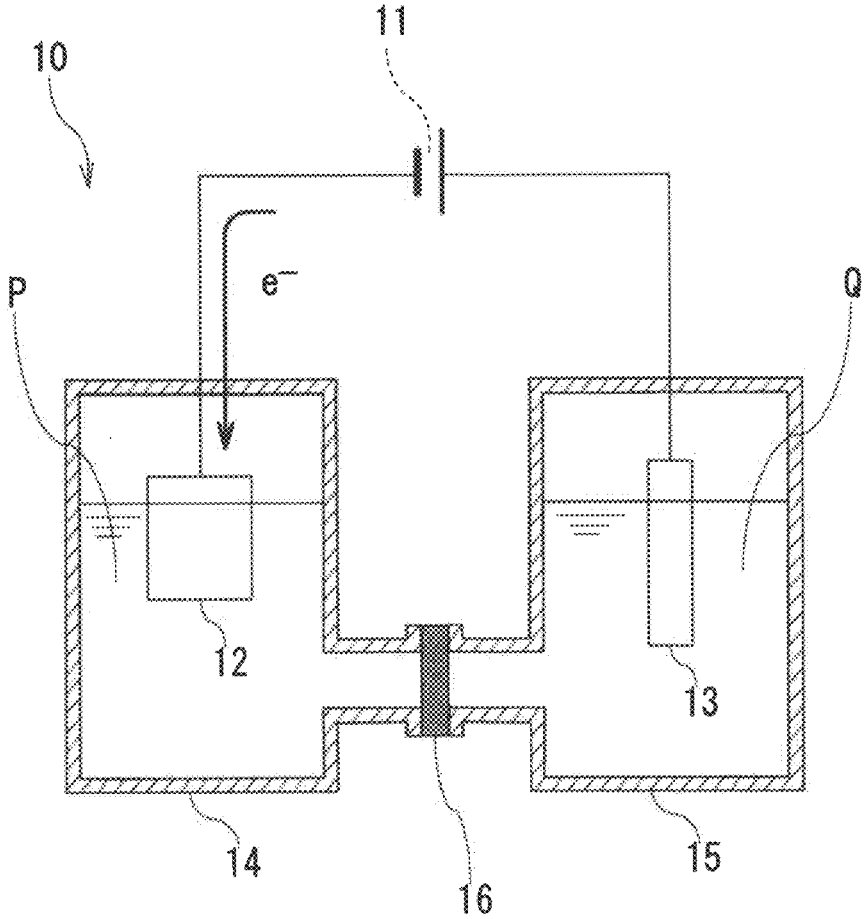
FIG. 1 is a schematic view showing an embodiment of a solution electrolytic tank, which is a component of a production system of rare metals according to the present invention.
Figure 2:
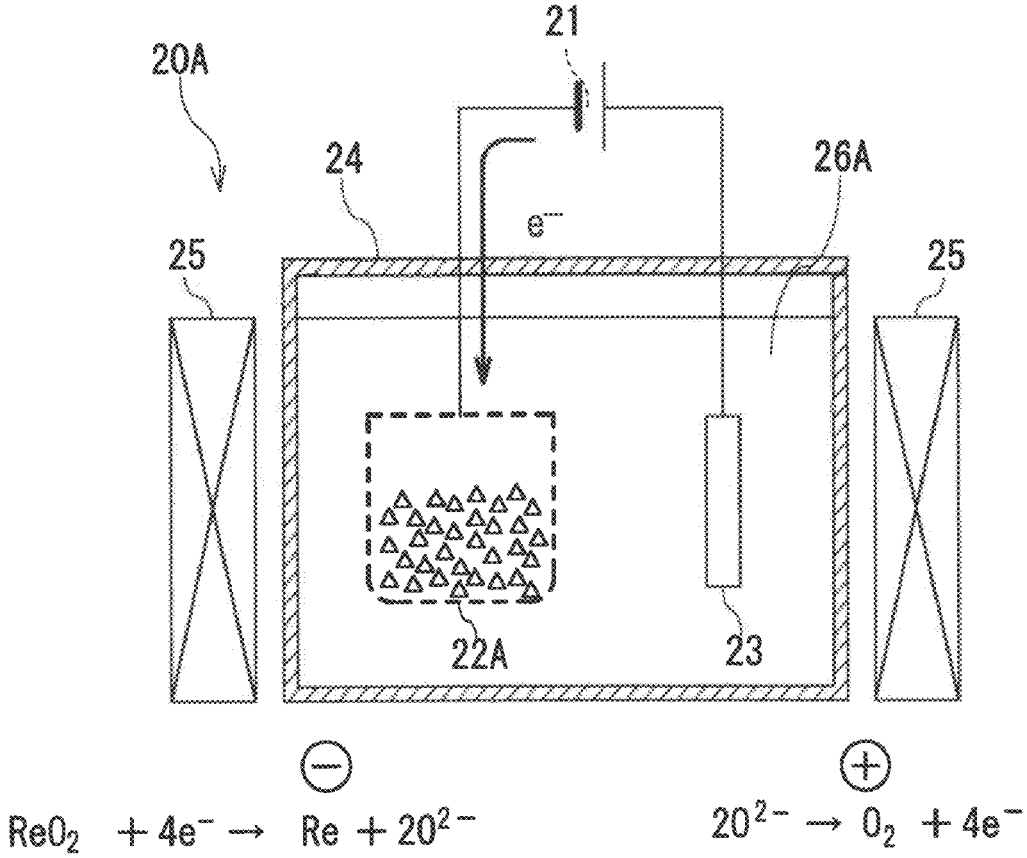
FIG. 2 is a schematic view showing an embodiment of a first molten salt electrolytic tank, which is a component of the production system of rare metals according to the present invention.

A production system of rare metals according to a first embodiment of the present invention includes a solution electrolytic tank 10 (FIG. 1) and a first molten salt electrolytic tank 20A (FIG. 2).

The production system having such a configuration separates and recovers Re oxide from an electrolytic solution P in which ions containing a Re element and ions containing other metallic elements are dissolved. Further, in the case that the other metallic elements are a Nd element and a Dy element belonging to rare earth metals, the production system isolates and recovers metallic Nd and metallic Dy independently.

As shown in FIG. 1, the solution electrolytic tank 10 includes a cathode 12 connected to a negative pole of a DC power supply 11; an anode 13 connected to a positive pole of the DC power supply 11; a cathode chamber 14 holding an electrolytic solution P in which the cathode 12 is immersed; an anode chamber 15 holding a buffer solution Q in which the anode 13 is immersed; and a diaphragm 16 disposed at a boundary between the cathode chamber 14 and the anode chamber 15.

In the solution electrolytic tank 10 having such a configuration, a Re oxide is deposited on the cathode 12 and extracted by electrolyzing the electrolytic solution P in which Re oxide ions are dissolved.

A solution used as this electrolytic solution P is a residue solution produced in wet refining to obtain a primary target metal such as uranium, copper, and molybdenum, but not limited to this. A solution containing the Re element, the Nd element, and the Dy element can be used properly.

As the buffer solution Q, the same acid solvent as the electrolytic solution P that does not contain the above-mentioned metallic elements is used. This buffer solution Q is separated from the electrolytic solution P by the diaphragm 16 so that the buffer solution Q may not be mixed with the electrolytic solution P and ions may freely pass through.

When voltage is applied between the cathode 12 and the anode 13 to perform electrolysis, the Re oxide ions dissolving in the electrolytic solution P are reduced to a Re oxide so that the Re oxide is deposited on the cathode 12. Then, the cathode 12 having the deposited Re oxide is taken out from the solution electrolytic tank 10, and calcined in the air at approximately 100 to 300° C. to remove moisture. Thus, powdered Re oxide is obtained.

A material for the cathode 12 needs to be a metallic material having large hydrogen overvoltage in order to suppress a hydrogen generating reaction that competes with a deposition reaction of the Re oxide.

Specifically, the material for the cathode 12 is desirably one of cadmium, mercury, thallium, indium, tin, lead, bismuth, graphite, copper, tantalum, niobium, beryllium, aluminum, silver, iron, molybdenum, nickel, smooth platinum, tungsten, and gold, or alloys thereof.

In the case of using tantalum for the cathode 12, an obtained result of examination shows that a recovery rate of the Re oxide reaches 70%. On the other hand, a recovery rate in the case of using platinum of a common cathode material is 13 to 16%. From this comparison, it is recognized that the recovery rate in the case of tantalum improves not less than 4 times that in the case of platinum.

Here, an electrode reaction in the cathode 12 and that in the anode 13 are represented by the following formulas (1) and (2), respectively.

It is known that the Re element has a valence from −1 to 7. Accordingly, the Re oxide has a variety of forms such as $ReO_2$, $ReO_3$, $Re_2O_7$, $Re_2O_3$, and an actual electrode reaction is complicated.

$$\text{Cathode; } ReO_4^- + 4H^+ + 3e^- \rightarrow ReO_2 + 2H_2O \quad (1)$$

$$\text{Anode; } 4OH^- \rightarrow 2H_2O + O_2 + 4e^- \quad (2)$$

After the electrode reactions (1) and (2) are completed, the electrolytic solution P remains in the solution electrolytic tank 10 as a Nd and Dy containing residue solution that contains the Nd element and the Dy element.

Next, a method for separating and recovering the Nd element and the Dy element from the Nd and Dy containing residue solution as a Nd oxide ($Nd_2O_3$) and a Dy oxide ($Dy_2O_3$) independently will be shown.

The Nd and Dy containing residue solution recovered from the solution electrolytic tank 10 is moved to other reaction tank (not shown). Then, an excessive amount of sodium sulfate ($Na_2SO_4$) as an alkali metal sulfate is added to the Nd and Dy containing residue solution, and the mixture is heated. Then, only Nd of a light rare earth metal crystallizes as neodymium sulfate ($Nd_2(SO_4)_3$) that is a Nd sulfuric acid salt, and selectively precipitates.

Subsequently, oxalic acid ($(COOH)_2$) is added to neodymium sulfate taken out from the reaction tank (not shown) to produce neodymium oxalate ($Nd_2(COO)_3$) that is a Nd oxalic acid salt.

The neodymium oxalate is dried to remove moisture. Subsequently, neodymium oxalate is mixed with potassium chloride (KCl) and lithium chloride (LiCl), and a temperature of the mixture is raised to approximately 500° C. in a heating furnace (not shown). Then, neodymium oxalate undergoes elimination of carbon monoxide (CO) in this mixed molten salt, and is converted into neodymium oxide ($Nd_2O_3$).

On the other hand, a heavy rare earth metal Dy is dissolved in the residue solution with other impurities even after neodymium sulfate crystallizes and precipitates. Then, by adding oxalic acid to the Dy containing residue solution, dysprosium oxalate ($Dy_2(COO)_3$) that is a Dy oxalic acid salt is produced, precipitated, and separated from other impurities.

Dysprosium oxalate is dried to remove moisture. Subsequently, in the same manner as in the case of the step mentioned above, dysprosium oxalate is mixed with potassium chloride (KCl) and lithium chloride (LiCl), and a temperature of the mixture is raised to approximately 500° C. in a heating furnace (not shown). Then, dysprosium oxalate undergoes elimination of carbon monoxide (CO) in this mixed molten salt, and is converted into dysprosium oxide ($Dy_2O_3$).

As shown in FIG. 2, the first molten salt electrolytic tank 20A includes a cathode 22A connected to a negative pole of a DC power supply 21; an anode 23 connected to a positive pole of the DC power supply 21; an electrolysis chamber 24 holding a first molten salt electrolyte 26A; and a heater 25 that controls a temperature of the first molten salt electrolyte 26A.

In the first molten salt electrolytic tank 20A having such a configuration, the Re oxide recovered from the solution electrolytic tank 10 is electrolyzed in the first molten salt electrolyte 26A, adhering components being removed from the Re oxide. Thereby, the Re oxide is reduced at the cathode 22A so that metallic Re is recovered.

Moreover, in the first molten salt electrolytic tank 20A, metallic Nd is recovered by electrolyzing the Nd oxide recovered from the Nd containing residue solution instead of the Re oxide. Similarly, in the first molten salt electrolytic tank 20A, metallic Dy is recovered by electrolyzing the Dy oxide recovered from the Dy containing residue solution.

The first molten salt electrolyte 26A can be one of mixed salts below: a mixed salt of lithium chloride (LiCl) and lithium oxide ($Li_2O$), a mixed salt of magnesium chloride ($MgCl_2$) and magnesium oxide (MgO), and a mixed salt of calcium chloride ($CaCl_2$) and calcium oxide (CaO).

Here, the mixed salt of lithium chloride and lithium oxide is suitably used for electrolysis of the Re oxide, and the mixed salt of magnesium chloride and magnesium oxide is suitably used for electrolysis of Nd oxide and Dy oxide.

Here, a proportion of a metal oxide component ($Li_2O$, MgO, and CaO) in the mixed salt which composes the first molten salt electrolyte 26A is approximately 1% of the entire mixed salt.

A role played by the metal oxide component will be described using a case of electrolysis of the Re oxide. Metallic Li produced by an electrode reaction of the following formula (3), which is concurrent with an electrode reaction of the formula (4) described later, gains oxygen molecules from the Re oxide. This can accelerate reduction of the Re oxide so that metallic Re can be recovered efficiently.

$$\text{Cathode; } Li_2O + 2e^- \rightarrow 2Li + O^{2-} \quad (3)$$

By the way, undesirable oxidization of the mixed salt which composes the first molten salt electrolyte 26A also progresses while electrolysis of the Re oxide, Nd oxide, or Dy oxide progresses. If progression of this undesirable oxidization increases the metal oxide component ($Li_2O$, MgO, and CaO) of the first molten salt electrolyte 26A, progression of electrolysis in the molten salt electrolytic tank 20A will be prevented.

Accordingly, from a viewpoint of reduction in an amount of produced secondary waste, it is preferable that a part of such an oxidized composition of the first molten salt electrolyte 26A be recovered, reduced, and reused.

A cathode 22A has a basket shape that holds a powder of the Re oxide, Nd oxide, or Dy oxide, and is made of stainless steel.

The cathode 22A is immersed in the first molten salt electrolyte 26A, and holds one of the Re oxide, Nd oxide, and Dy oxide while the oxide is reduced to a metal.

An anode 23 can be made of a material such as platinum or carbon, and removes oxygen ions as gaseous oxygen or gaseous carbon dioxide.

Next, an electrode reaction in each case of electrolyzing the Re oxide, Nd oxide, and Dy oxide will be shown. In the anodic reaction, platinum is used for an anode.

<Re oxide>

$$\text{Cathode; } ReO_2+4e^- \rightarrow Re+2O^{2-} \quad (4)$$

$$\text{Anode; } 2O^{2-} \rightarrow O_2+4e^- \quad (5)$$

<Nd oxide>

$$\text{Cathode; } Nd_2O_3+6e^- \rightarrow 2Nd+3O^{2-} \quad (6)$$

$$\text{Anode; } 3O^{2-} \rightarrow 3/2O_2+6e^- \quad (7)$$

<Dy oxide>

$$\text{Cathode; } Dy_2O_3+6e^- \rightarrow 2Dy+3O^{2-} \quad (8)$$

$$\text{Anode; } 3O^{2-} \rightarrow 3/2O_2+6e^- \quad (9)$$

Figure 4:
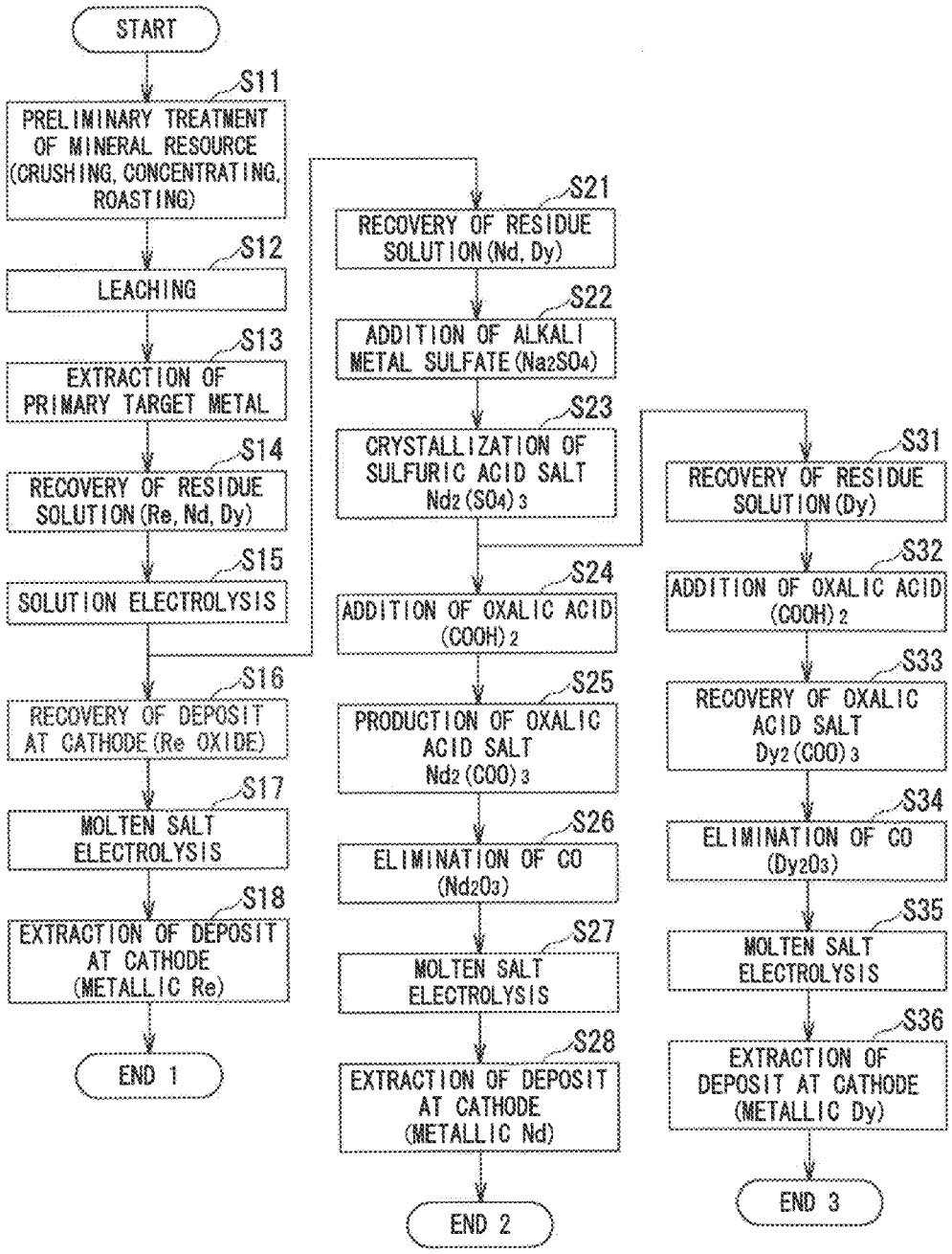
FIG. 4 is a flow chart showing a first embodiment of a process for producing rare metals according to the present invention.

A process (procedure) for producing rare metals according to the first embodiment will be described with reference to a flow chart in FIG. 4.

First, an ore mineral is subjected to preliminary treatment (crushing, concentrating, roasting) (S11), and leached with an acid or alkaline solution (S12). A primary target metal is extracted from the leaching solution (S13). A residue solution that remains after extraction of the primary target metal and contains the Re element, the Nd element, and the Dy element is recovered (S14).

The residue solution is held as the electrolytic solution P in the cathode chamber 14 of the solution electrolytic tank 10. The Re oxide is deposited on the cathode 12 by electrolysis and extracted (S15).

The Re oxide is recovered and adhering components are removed therefrom (S16).

The Re oxide is held by the cathode 22A of the first molten salt electrolytic tank 20A and electrolyzed (S17).

Then, after the electrolysis is completed, the cathode 22A is taken out from the first molten salt electrolyte 26A so that metallic Re is extracted as a subproduct metal (S18).

On the other hand, after the electrolysis step (S15) in the solution electrolytic tank 10 is completed, the Nd and Dy containing residue solution that remains after extraction of the Re oxide and contains the Nd element and the Dy element is recovered (S21).

An alkali metal sulfate ($Na_2SO_4$) is added to this Nd and Dy containing residue solution (S22) to crystallize a Nd sulfuric acid salt ($Nd_2(SO_4)_3$) (S23).

Then, the Nd sulfuric acid salt ($Nd_2(SO_4)_3$) is recovered. Oxalic acid ($(COOH)_2$) is added to and reacted with this Nd sulfuric acid salt (S24) to produce a Nd oxalic acid salt ($Nd_2(COO)_3$) (S25). CO is eliminated from this Nd oxalic acid salt to produce Nd oxide ($Nd_2O_3$) (S26).

The Nd oxide is recovered, and held by the cathode 22A of the first molten salt electrolytic tank 20A, and electrolyzed (S27). Then, after the electrolysis is completed, the cathode 22A is taken out from the first molten salt electrolyte 26A so that metallic Nd is extracted as a secondary target metal (S28).

Moreover, after the step of crystallizing the Nd sulfuric acid salt (S23) is completed, the Dy containing residue solution that remains after extraction of the Nd sulfuric acid salt and contains the Dy element is recovered (S31).

Oxalic acid ($(COOH)_2$) is added to this Dy containing residue solution to crystallize a Dy oxalic acid salt (S32), and the crystallized Dy oxalic acid salt ($Dy_2(COO)_3$) is recovered (S33).

CO is eliminated from this Dy oxalic acid salt to produce Dy oxide ($Dy_2O_3$) (S34).

This Dy oxide is recovered, held by the cathode 22A of the first molten salt electrolytic tank 20A (S35), and subjected to molten salt electrolysis. Then, after the electrolysis is completed, the cathode 22A is taken out from the first molten salt electrolyte 26A so that metallic Dy is extracted as a subproduct metal (S36).

According to the process for producing rare metals according to the first embodiment of the present invention, an amount of produced secondary wastes is 500 kg/year, which is an approximately 50% reduction compared with 1000 kg/year in the conventional process.

(A Second Embodiment)

Figure 3:
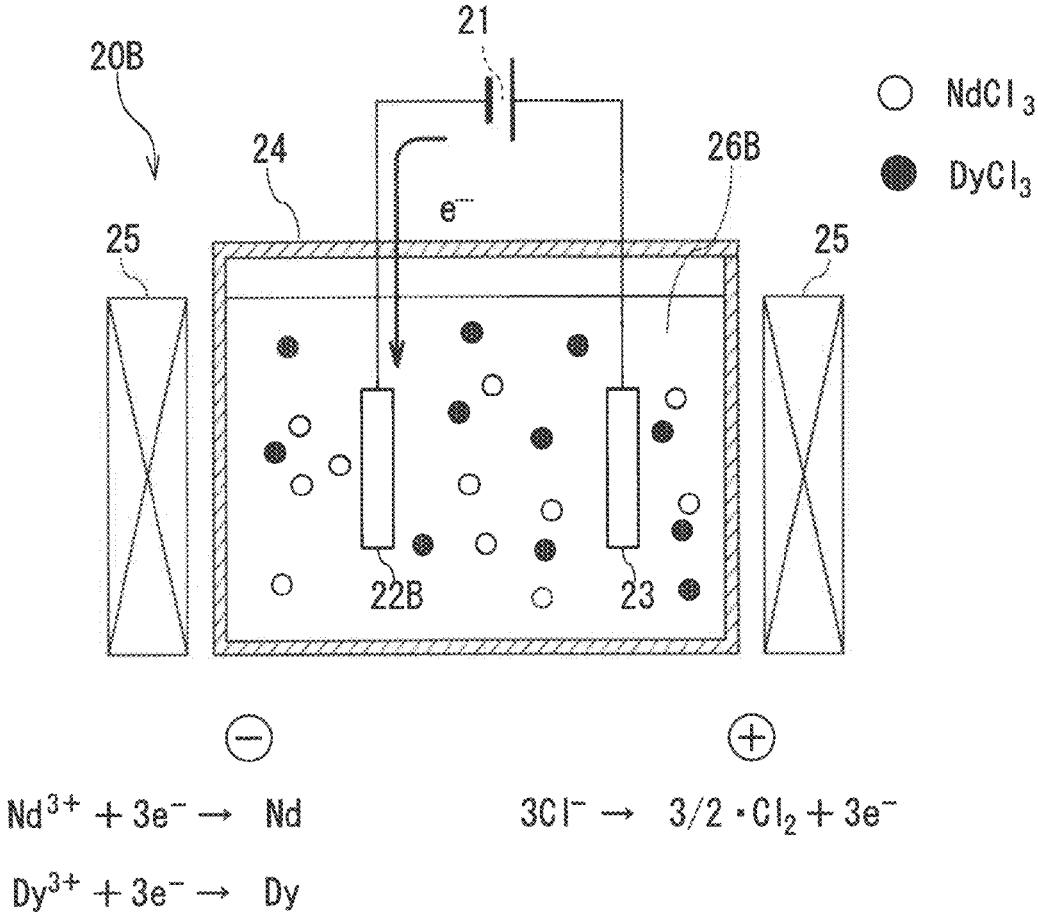
FIG. 3 is a schematic view showing an embodiment of a second molten salt electrolytic tank, which is a component of the production system of rare metals according to the present invention.

A production system of rare metals according to a second embodiment of the present invention includes a solution electrolytic tank 10 (FIG. 1), a first molten salt electrolytic tank 20A (FIG. 2), and a second molten salt electrolytic tank 20B (FIG. 3).

Here, the solution electrolytic tank 10 is the same as that already described, and description thereof will be omitted. Among components described in FIG. 3 in the second molten salt electrolytic tank 20B, same reference numerals will be given to components common to those described in FIG. 2, and description thereof will be omitted by citation of the above-mentioned description.

The production system according to the second embodiment having such a configuration also isolates and recovers metallic Re from an electrolytic solution P first in the same manner as in the case of the first embodiment.

On the other hand, unlike the first embodiment, the production system according to the second embodiment separates and recovers the Nd element and Dy element of rare earth metals from a residue solution after separation of Re.

First, before description of the second molten salt electrolytic tank 20B, pretreatment of a Nd and Dy containing residue solution to be discharged from the solution electrolytic tank 10 and electrolyzed in the second molten salt electrolytic tank 20B will be described.

The Nd and Dy containing residue solution recovered from the solution electrolytic tank 10 is moved to other reaction tank (not shown), and oxalic acid ($(COOH)_2$) is added. Then, a mixture of neodymium oxalate ($Nd_2(COO)_3$) which is a Nd oxalic acid salt and dysprosium oxalate ($Dy_2(COO)_3$) which is a Dy oxalic acid salt is produced and precipitated.

Hydrochloric acid (HCl) as a chloridizing agent is added to this precipitated neodymium oxalate and dysprosium oxalate, and a temperature of the mixture is set at approximately 90° C. Then, neodymium oxalate and dysprosium oxalate chemically change to neodymium chloride ($NdCl_3$) which is a Nd hydrochloric acid salt and dysprosium chloride ($DyCl_3$) which is a Dy hydrochloric acid salt, respectively, and subsequently turns into a chloride solution in which neodymium chloride and dysprosium chloride are dissolved in a chloride solvent.

Then, when the chloride solution is heated while hydrogen peroxide is added to the chloride solution, unreacted oxalic acid can be decomposed into chlorides and removed.

This chloride solution is further heated and dried at a temperature of approximately 200° C. in an inert gas atmosphere to remove moisture completely. Thus, a mixture of anhydrous neodymium chloride and anhydrous dysprosium chloride, i.e., a mixture of a Nd hydrochloric acid salt and a Dy hydrochloric acid salt is produced.

The pretreatment of the Nd and Dy containing residue solution has been described as above.

As shown in FIG. 3, the second molten salt electrolytic tank 20B includes a cathode 22B connected to a negative pole of a DC power supply 21, an anode 23 connected to a positive pole of the DC power supply 21, an electrolysis chamber 24 holding a second molten salt electrolyte 26B, and a heater 25 that controls a temperature of the second molten salt electrolyte 26B.

In the second molten salt electrolytic tank 20B having such a configuration, the mixture of the Nd hydrochloric acid salt and Dy hydrochloric acid salt obtained by the pretreatment is electrolyzed at the second molten salt electrolyte 26B. Metallic Nd is selectively deposited by the cathode 22B, and then, the cathode 22B is exchanged for another one to selectively deposit metallic Dy.

As the second molten salt electrolyte 26B, mixed salts of binary systems of chlorides of alkali metals such as a mixed salt of potassium chloride (KCl) and sodium chloride (NaCl), a mixed salt of potassium chloride (KCl) and lithium chloride (LiCl), and a mixed salt of sodium chloride (NaCl) and cesium chloride (CsCl), or mixed salts of binary systems of chlorides of alkaline earth metals can be used.

A mixed salt of potassium fluoride and sodium fluoride can also be used.

Among Nd ions ($Nd^{3+}$) and Dy ions ($Dy^{3+}$) dissolving in the molten salt, the Nd ions having a higher oxidation reduction potential are preferentially reduced to metallic Nd so that the metallic Nd is deposited at the cathode 22B. Thus, metallic Nd is recovered on the cathode 22B (the reaction formula (10)).

Next, the cathode 22B is exchanged for new one, and voltage is applied between the cathode 22B and the anode 23. Then, the Dy ions are reduced to metallic Dy so that the metallic Dy is deposited on the cathode 22B. Thus, metallic Dy is recovered (the reaction formula (11)).

On the other hand, at the anode 23, chlorine ions become gaseous chlorine to be discharged (the reaction formula (12)).

$$\text{Cathode; } Nd^{3+}+3e^{-}\rightarrow Nd(\text{first stage}) \quad (10);$$

$$Dy^{3+}+3e^{-}\rightarrow Dy(\text{second stage}) \quad (11)$$

$$\text{Anode; } 3Cl^{-}\rightarrow 3/2.Cl_2+3e^{-} \quad (12)$$

Figure 5:
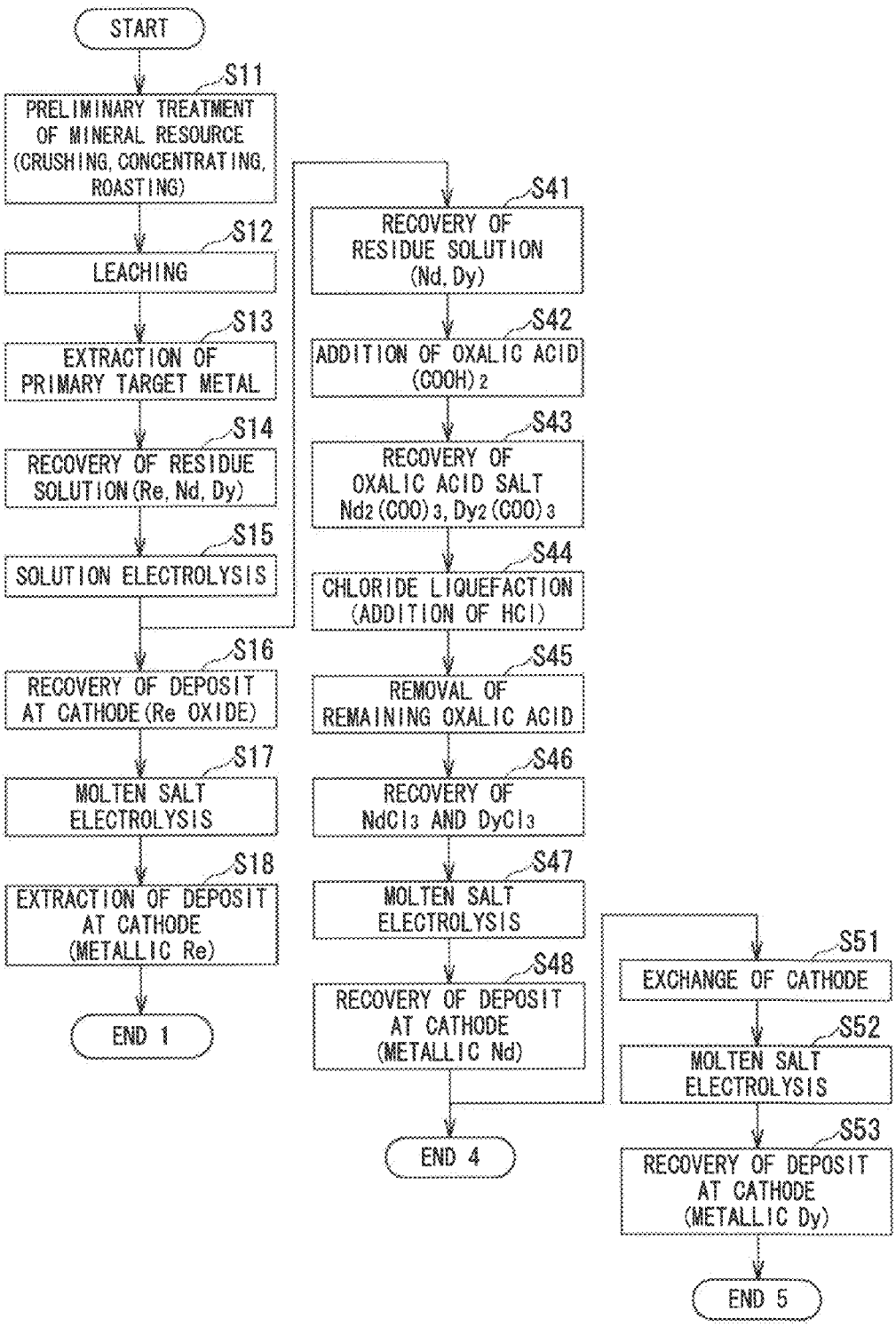
FIG. 5 is a flow chart showing a second embodiment of a process for producing rare metals according to the present invention.

A process (procedure) for producing rare metals according to the second embodiment will be described with reference to a flow chart in FIG. 5.

Steps S11 to S18 in the second embodiment are the same as those in the first embodiment, and description thereof will be omitted by citation of the description already given.

After an electrolysis step (S15) in the solution electrolytic tank 10 is completed, a Nd and Dy containing residue solution that remains after extraction of the Re oxide and containing the Nd element and the Dy element is recovered (S41).

Oxalic acid ($(COOH)_2$) is added to and reacted with the Nd and Dy containing residue solution to crystallize a Nd oxalic acid salt ($Nd_2(COO)_3$) and a Dy oxalic acid salt ($Dy_2(COO)_3$) (S42). The mixture of the Nd oxalic acid salt ($Nd_2(COO)_3$) and the Dy oxalic acid salt ($Dy_2(COO)_3$) thus crystallized is recovered (S43).

Then, HCl is added as a chloridizing agent into the mixture of the Nd oxalic acid salt and the Dy oxalic acid salt to prepare a mixed solution of a Nd hydrochloric acid salt ($NdCl_3$) and a Dy hydrochloric acid salt ($DyCl_3$) (S44).

Hydrogen peroxide is added to the mixed solution of the Nd hydrochloric acid salt and the Dy hydrochloric acid salt to remove remaining oxalic acid (S45).

The solvent is removed from the mixed solution, and the mixture of the Nd hydrochloric acid salt and the Dy hydrochloric acid salt is recovered (S46).

Next, the mixture of the Nd hydrochloric acid salt and the Dy hydrochloric acid salt is mixed with the second molten salt electrolyte 26B in the second molten salt electrolytic tank 20B, and molten salt electrolysis is performed (S47). Thereby, metallic Nd is selectively deposited at the cathode 22B, and extracted as a secondary target metal (S48).

Next, the cathode 22B having metallic Nd deposited thereon is taken out, and exchanged for another cathode (S51). Then, molten salt electrolysis is performed on the Dy hydrochloric acid salt that remains in the second molten salt electrolyte 26B (S52). Thereby, metallic Dy is selectively deposited on the new cathode 22B, and extracted as a sub-product metal (S53).

While certain embodiments have been described, these embodiments have been presented by way of example only, and are not intended to limit the scope of the inventions. Indeed, the novel process and system described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

For example, the embodiments are based on the premised that all of the Re element, the Nd element, and the Dy element are contained in the electrolytic solution P. However, even if one of these elements may be missing, the other elements can be separated and recovered as a metal independently.

While recovery of rare metals from the residue solution after extraction of a primary target metal from an ore mineral has been shown as an example, the present invention will not be limited to such an application.

What is claimed is:

1. A process for producing rare metals comprising the steps of:

electrolyzing an electrolytic solution containing at least a Re element to extract a Re oxide at a cathode;

recovering the Re oxide; and electrolyzing the Re oxide in a first molten salt electrolyte to extract metallic Re at a cathode.

2. The process for producing rare metals according to claim 1, wherein the electrolytic solution further contains a Nd element, and the process further comprises the steps of:

recovering a Nd containing residue solution containing the Nd element after the step of electrolyzing the electrolytic solution is completed;

adding an alkali metal sulfate to the Nd containing residue solution to crystallize a Nd sulfuric acid salt;

recovering the Nd sulfuric acid salt, and reacting the Nd sulfuric acid salt with oxalic acid to produce a Nd oxalic acid salt;

treating the Nd oxalic acid salt to produce Nd oxide; and electrolyzing the Nd oxide in a first molten salt electrolyte to extract metallic Nd at a cathode.

3. The process for producing rare metals according to claim 2, wherein the electrolytic solution further contains a Dy element, and the process further comprises the steps of:

recovering a Dy containing residue solution containing the Dy element after the step of crystallizing the Nd sulfuric acid salt is completed;

recovering a Dy oxalic acid salt crystallized by adding oxalic acid to the Dy containing residue solution;

treating the Dy oxalic acid salt to produce Dy oxide; and electrolyzing the Dy oxide in the first molten salt electrolyte to extract metallic Dy at a cathode.

4. The process for producing rare metals according to claim 1, wherein the electrolytic solution further contains a Nd element and a Dy element, and the process further comprises the steps of:

recovering a Nd and Dy containing residue solution containing a Nd element and a Dy element after the step of electrolyzing the electrolytic solution is completed;

recovering a mixture of a Nd oxalic acid salt and a Dy oxalic acid salt crystallized by adding oxalic acid to the Nd and Dy containing residue solution;

recovering a mixture of a Nd hydrochloric acid salt and a Dy hydrochloric acid salt produced by adding a chloridizing agent to the mixture of the Nd oxalic acid salt and the Dy oxalic acid salt;

electrolyzing the mixture of the Nd hydrochloric acid salt and the Dy hydrochloric acid salt in a second molten salt electrolyte to selectively extract metallic Nd at a cathode;

taking out the cathode having the metallic Nd deposited thereon and exchanging the cathode for another cathode; and electrolyzing a remaining Dy hydrochloric acid salt in the second molten salt electrolyte to selectively extract metallic Dy at the exchanged cathode.

5. The process for producing rare metals according to claim 4, wherein at the step of recovering the mixture of the Nd hydrochloric acid salt and the Dy hydrochloric acid salt, hydrogen peroxide is added to the mixture to remove the remaining oxalic acid.

6. The process for producing rare metals according to claim 1, wherein in a course where electrolysis is performed using the first molten salt electrolyte, a part of an oxidized composition of the first molten salt electrolyte is recovered, and reduced, and reused.

7. The process for producing rare metals according to claim 1, wherein the electrolytic solution is a residue solution after an ore mineral is leached to extract a primary target metal, and the metallic Re is a secondary target metal.

* * * * *